US005765236A

United States Patent [19]

Bethanis

[11] Patent Number: 5,765,236

[45] Date of Patent: Jun. 16, 1998

[54] TOILET SEAT WITH MULTIPLE HANDLES

[76] Inventor: C. James Bethanis, 255 Canyon Shadows Dr., Sedona, Ariz. 86336

[21] Appl. No.: 855,299

[22] Filed: May 13, 1997

[51] Int. Cl.[6] ..... A47K 13/00

[52] U.S. Cl. ..... 4/237; 4/246.1; 4/254

[58] Field of Search ..... 4/237, 246.1, 254

[56] References Cited

U.S. PATENT DOCUMENTS

| | | | |
|---|---|---|---|
| 161,108 | 12/1875 | Kandarian . | |
| 336,954 | 6/1886 | Paglia | 23/311 |
| 1,668,729 | 5/1928 | Olsen . | |
| 2,598,577 | 5/1952 | Mattison . | |
| 3,594,831 | 7/1971 | Brewer | 4/237 |
| 3,783,455 | 1/1974 | Vanderbrook | 4/1 |
| 4,168,552 | 9/1979 | Austin | 4/254 X |
| 4,574,401 | 3/1986 | Nakajima | 4/251 |
| 4,707,870 | 11/1987 | Glassco et al. | 4/661 |
| 4,805,246 | 2/1989 | DeVargas et al. | 4/251 |
| 4,843,656 | 7/1989 | Forman | 4/251 |
| 4,977,628 | 12/1990 | Barrett | 4/237 |

OTHER PUBLICATIONS

"Photo Copy of a Toilet Seat Handle Sold in a 'Bubble Package' Under the Trade Name SanoTouch™ (Front and Back)".

*Primary Examiner*—Charles E. Phillips
*Attorney, Agent, or Firm*—Meschkow & Gresham, PLC; Lowell W. Gresham; Jordan M. Meschkow

[57] ABSTRACT

An improved toilet seat is provided that includes a number of integral handles configured such that a person using the seat can stabilize or balance his or her body while exerting downward force on the seat. The toilet seat includes a seating element having an upper surface, an outer periphery that extends beyond an upper rim of a toilet bowl, a plurality of handles integrally formed in the seating element, a rear section, a narrow front section that forms at least one handle, and a transition section from the rear section to the narrow front section. Domestic, commercial, and other embodiments are also provided.

7 Claims, 3 Drawing Sheets

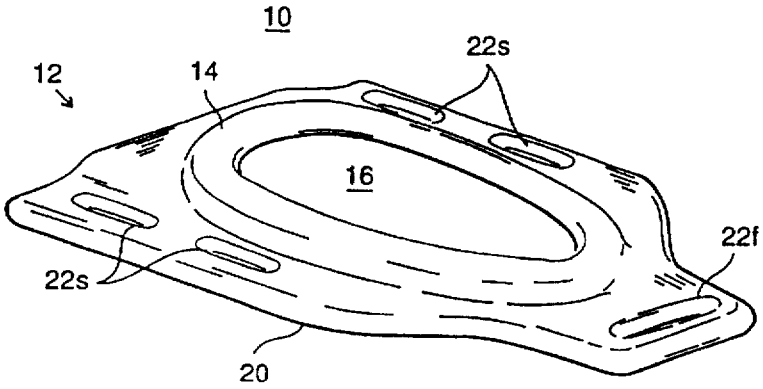
Fig. 1
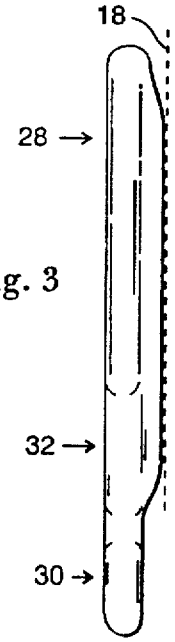
Fig. 3
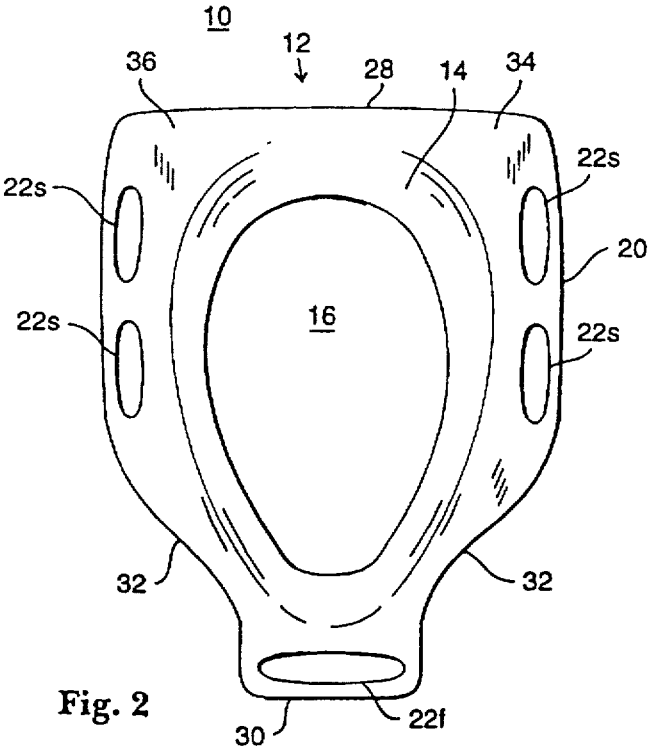
Fig. 2
Fig. 4
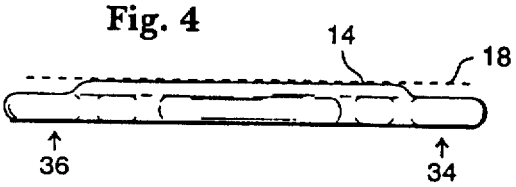
Fig. 5
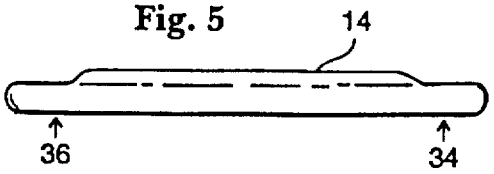

Fig. 6
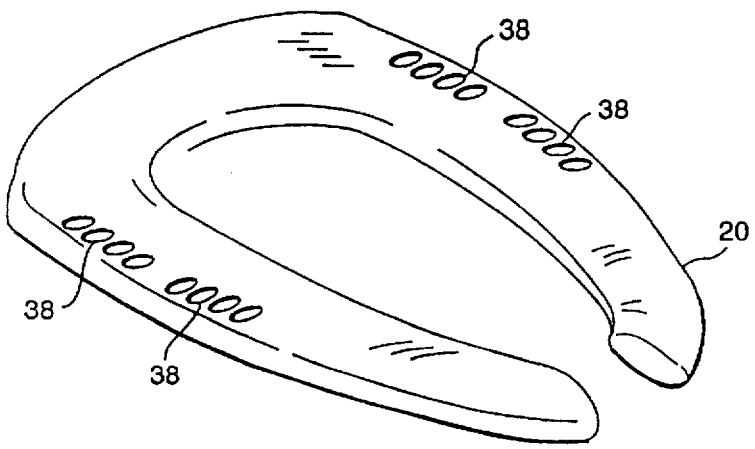
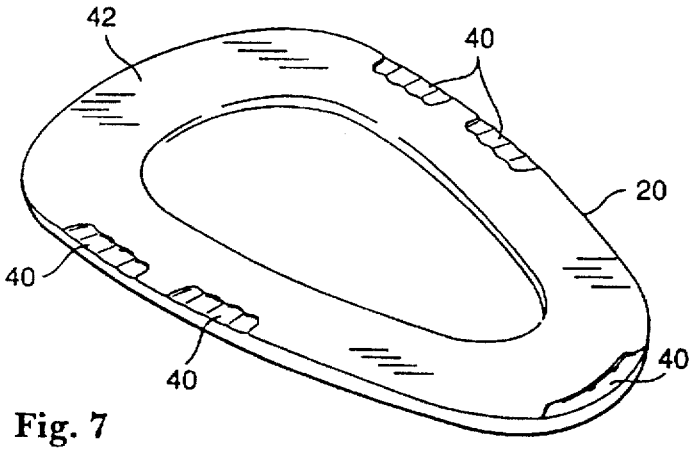
Fig. 7
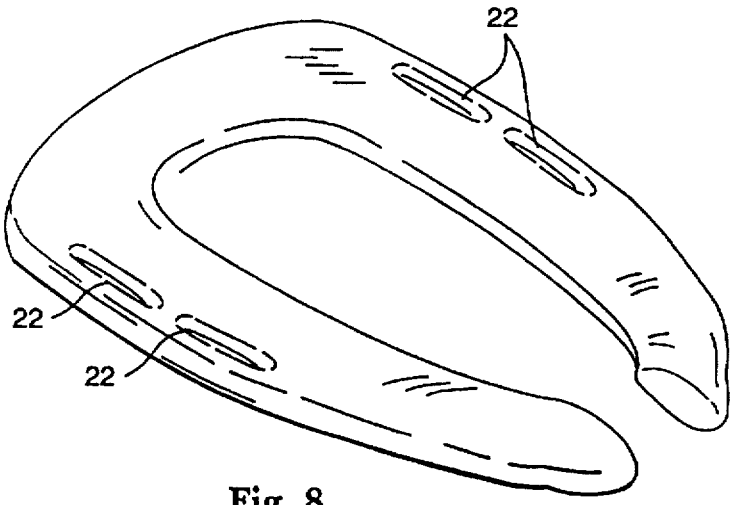
Fig. 8

TOILET SEAT WITH MULTIPLE HANDLES

FIELD OF THE INVENTION

The present invention relates generally to toilet seats, and specifically to toilet seats having handles.

BACKGROUND OF THE INVENTION

Toilets and toilet seats are common household and commercial fixtures that are well known in the prior art. Many modifications and variations on standard toilet seats have been developed and documented over the years. For example, the shape, size, and function of toilet seats have been improved upon or varied according to specific applications. One modification of this sort has been the addition of handles to standard toilet seats.

Some prior art toilet seats include one or more handles for raising and lowering the seat. Other known toilet seats include "handles" or fixtures that secure the seats in a raised or lowered position. Another modification provides a standard toilet seat with a handle or a fixture that contains deodorant or disinfectant. Although these modified toilet seats may be adequate for some purposes, they are not designed to suit the needs of a person who requires physical stabilizing assistance or extra-abdominal force assistance while using a toilet. In particular, such handles are often designed for sanitary purposes so that the toilet seat may be raised and lowered by touching only the handle and not the body of the seat itself. They cannot support the application of a significant amount of force.

Certain people have difficulty maintaining their balance while sitting on a toilet. In particular, elderly persons, persons afflicted with balance-affecting disorders, or young children (whose feet may not reach the floor when sitting on a toilet) may require some way to stabilize themselves while seated. The prior art toilet seats mentioned above may not be adequately configured to help a person stabilize or balance himself or herself while using the seats. Therefore, there is a need for a toilet seat that can assist people who have balance, stabilizing or tremor problems.

In addition, certain people have medical conditions which cause them to have trouble defecating due to constipation or other medical reasons. For example, some individuals find it difficult to sufficiently contract their abdominal and other lower body muscles during a bowel movement. The known toilet seats described above do not address this problem. It is easier to effectively contract the abdominal and other muscles when one sits with the proper posture and imparts extra-abdominal downward pressure on the seat area. Thus, it would be desirable to have a toilet seat configured to help a person effectively contract his or her abdominal and other muscles during a bowel movement.

One known toilet seat, which is designed to elevate the sitting position of the user, includes handles that are used to lift and situate the body of the user. Since these handles are designed to aid wheelchair-bound persons, they extend upward and outward in relation to the sitting surface. Although this seat may be useful for its intended purpose, the configuration of the handles renders it ineffective for purposes of contracting various muscles (as described above).

In addition, many prior art toilet seats with handles, including the above-discussed elevating seat, have only one or two handles. This small number of handles has been discovered to be particularly unsuitable for stability and extra-abdominal force problems because a person does not have a choice of gripping locations from which to choose to suit his or her particular instant needs. As such, there is a need for a toilet seat that includes a more than two of handles configured such that a user can quickly achieve a desired stability reinforcement or effectively force his or her body downward onto the seat by applying external forces from a direction which may best suit the instant needs.

SUMMARY OF THE INVENTION

Accordingly, it is an advantage of the present invention that an improved toilet seat with multiple handles is provided with the handles being configured to allow a person to stabilize or balance himself or herself while using the seat.

A further advantage of the present invention is that an improved toilet seat is provided with multiple handles configured to allow a person to effectively contract his or her abdominal muscles during a bowel movement.

An additional advantage of the present invention is that an improved toilet seat is provided with multiple handles configured such that a user can effectively force his or her body downward onto the seat.

The above and other advantages of the present invention are carried out in one form by a toilet seat for use by persons in need of stabilization assistance. The toilet seat is used in cooperation with a toilet bowl having an upper rim. The seat includes an outer periphery that extends beyond the upper rim of the toilet bowl. An upper surface of the seat substantially defines a seating plane. A left section of the seat has at least two handles formed by openings extending through the seat proximate the periphery thereof so that the left section handles are integrally formed into the seat and are approximately coplanar with the seating plane. A right section of the seat has at least two handles formed by openings extending through the seat proximate the periphery thereof so that the right section handles are integrally formed into the seat and are approximately coplanar with the seating plane.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

FIG. 1 shows a perspective view of an improved toilet seat according to the present invention;

FIG. 2 shows a top view of the toilet seat shown in FIG. 1;

FIG. 3 shows a left side view of the toilet seat shown in FIG. 1;

FIG. 4 shows a front side view of the toilet seat shown in FIG. 1;

FIG. 5 shows a rear side view of the toilet seat shown in FIG. 1;

FIGS. 6–8 show alternate configurations for a toilet seat according to the present invention;

DETAILED DESCRIPTION OF THE PREFERRED EMBODIMENTS

Figure 9:
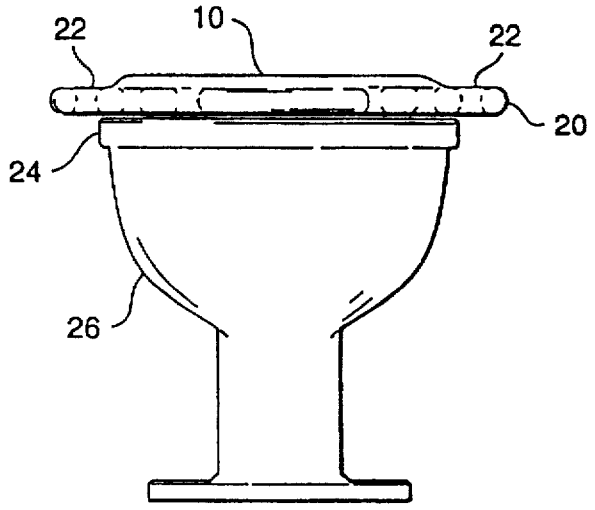
FIG. 9 shows a front side view of a toilet seat according to the present invention as installed on a conventional toilet bowl.

Referring to FIGS. 1–5, a toilet seat 10 according to a preferred embodiment of the present invention is illustrated.

In general, toilet seat 10 may be sized to fit any conventional domestic or commercial toilet. Toilet bowl assemblies are well known, therefore this description will not address ordinary aspects of toilet bowls unless they are required for an understanding of the present invention. Briefly, toilet seat 10 includes a seating element 12 having an upper surface 14, an outer periphery 20, a plurality of handles 22 integrally formed in seating element 12, a rear section 28, a narrow front section 30, and a transition section 32 between rear section 28 and narrow front section 30.

Certain aspects of toilet seat 10 may be similar to conventional toilet seats. For example, seating element 12 includes upper surface 14 upon which a user sits during use. Like other toilet seats, upper surface 14 is preferably contoured to provide a comfortable sitting surface. As another example, toilet seat 10 may be configured in a "closed front" shape typically associated with domestic uses (see FIG. 2), or in a horseshoe shape typically associated with commercial uses (see FIG. 8). Of course, in either configuration toilet seat 10 includes an opening 16 formed therein. In addition, toilet seat 10 may be pivotally connected to a toilet bowl (not shown) with or without a toilet bowl cover (not shown). Seating element 12 is preferably constructed from a material commonly used for toilet seats, such as plastic, wood, and the like.

As mentioned above, seating element 12 includes upper surface 14. Upper surface 14 substantially defines a seating plane 18, which is approximately horizontal when toilet seat 10 is in a lowered position (see FIGS. 3–4). Seating element 12 is defined by outer periphery 20, and is shaped to accommodate handles 22 (described in detail below). With brief reference to FIG. 9, outer periphery 20 extends beyond an upper rim 24 of a toilet bowl 26 such that a person seated on toilet seat 10 has access to handles 22. In addition to allowing access to handles 22, this preferred configuration also ensures that a user does not contact upper rim 24 (or any other part of toilet bowl 26) during use.

Figure 10:
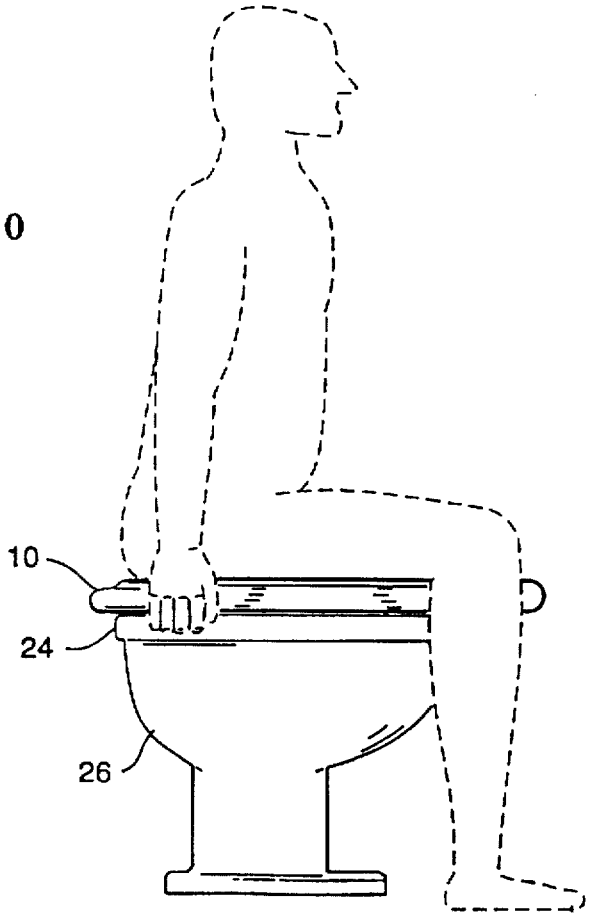
FIG. 10 shows a person using the toilet seat shown in FIG. 9.

With reference again to FIGS. 1–5, seating element 12 is preferably shaped for comfort and ease of use. As shown, rear section 28 is preferably wider than narrow front section 30. According to one aspect of the present invention, transition section 32 from rear section 28 to narrow front section 30 is shaped to accommodate the legs of a person seated on toilet seat 10. As shown in FIG. 10, a user may straddle narrow front section 30 during use with his or her legs resting comfortably near transition section 32. Of course, if a commercial (horseshoe shaped) embodiment of toilet seat 10 is contemplated, then narrow front section 30 may not be implemented (see FIG. 8).

According to a preferred embodiment, toilet seat 10 includes handles 22 located at various positions around outer periphery 20. In the preferred embodiment handles 22 are integrally formed within seating element 12. Due to the "closed front" nature of the preferred embodiment, a front handle **22*f* may be located at narrow front section 30. The variety of locations for handles 22 allows a person to select from a number of grasping positions to best serve his or her individual needs. As described above, handles 22 are accessible to a user due to the extension of outer periphery 20 beyond upper rim 24 of toilet bowl 26 (see FIGS. 9–10**).

With additional reference to FIG. 10, the use of toilet seat 10 will be described. A person may utilize handles 22 separately or in combination to help himself or herself sit down on or stand up from toilet seat 10. Similarly, handles 22 may be utilized by a person to stabilize or balance himself or herself while seated. Furthermore, if an individual is having difficulty defecating, then handles 22 may be grasped and utilized to enhance the contraction of the abdominal or other muscles. By having at least three and preferably more handles distributed around seat 10, the user has a selection of locations to grasp. Thus, the user can quickly grab a handle which best suits his or her instant stabilization or extra-abdominal force needs.

According to the preferred embodiment, a plurality of side handles **22*s* are substantially oval in shape, and sized to accommodate at least one hand of a user. Front handle 22*f* is preferably sized larger than side handles 22*s* to accommodate both hands, if necessary. As shown in FIG. 10, toilet seat 10 is configured to allow a user to fit his or her fingers through seating element 12, grasp handles 22, and, if necessary, pull upward on handles 22 to force his or her body downward onto seating element 12**. This action makes it easier for a user to contract his or her abdominal muscles during a bowel movement.

To facilitate the production of sufficient force, handles 22 are approximately coplanar with seating plane 18 (see FIGS. 3–4). Due to the thickness and contour of toilet seat 10, handles 22 may be slightly above or slightly below seating plane 18, as shown. Since handles 22 are approximately level with seating plane 18, rather than well above the surface of seating plane 18, the geometry of the user's arms allows for the exertion of greater downward forces. In addition, handles 22 are preferably located near to the user's body, otherwise relatively smaller downward forces for a given amount of user arm exertion would also be produced. Side handles **22*s* are formed in a right section 34 and a left section 36 of seating element 12. According to one preferred aspect, side handles 22*s* are approximately aligned with the front-to-back center of gravity of a person seated on toilet seat 10 (see FIG. 10). This alignment allows a person to maintain his or her vertical orientation and balance while using toilet seat 10. In addition, the preferred location and configuration of handles 22 are ergonomical, which increases the comfort of toilet seat 10**.

With reference now to FIG. 6, a second embodiment of the present invention is illustrated. As shown, the second embodiment includes a plurality of fingerhole groups 38 instead of handles. Fingerhole groups 38 require less material near outer periphery 20, thus the second embodiment may be utilized where space restrictions prevent the use of the preferred embodiment described above. As described above, the second embodiment may be configured for use in domestic (closed front) or commercial (horseshoe) applications.

With reference to FIG. 7, a third embodiment of the present invention is illustrated. As shown, the third embodiment includes a plurality of indentations 40 formed in a lower surface 42 of seating element 12. Indentations 40 provide grasping locations for a user without creating holes in seating element 12. As described above in connection with the second embodiment, this embodiment may also be utilized where space restrictions prevent the use of the "handle" embodiment of the present invention. The third embodiment may also be configured with a closed front or horseshoe shape.

In summary, the present invention provides an improved multiple handle toilet seat that allows a person to stabilize or balance himself or herself while using the seat. In addition, an improved toilet seat is provided that allows a person to effectively contract his or her abdominal muscles during a bowel movement. A toilet seat is also provided with multiple handles configured such that a user can effectively force his or her body downward onto the seat from a variety of different locations.

The above description is of preferred embodiments of the present invention, and the invention is not limited to the specific embodiments described and illustrated. For example, various descriptors such as front, side, upper, and lower have been used in a relative sense to maintain consistency with the Figures. These descriptors have been used in an ordinary manner and should not be construed as limiting in any way. Furthermore, many variations and modifications will be evident to those skilled in this art, and such variations and modifications are intended to be included within the spirit and scope of the invention, as expressed in the following claims.

What is claimed is:

1. A toilet seat for use by persons in need of stabilization assistance, said toilet seat being used in cooperation with a toilet bowl having an upper rim, said toilet seat comprising:

an outer periphery that extends beyond said upper rim of said toilet bowl;

an upper surface that substantially defines a seating plane;

a left section in which are formed at least two handles by openings extending through said seat proximate said periphery thereof so that said left section handles are integrally formed into said seat and are approximately coplanar with said seating plane; and a right section in which are formed at least two handles by openings extending through said seat proximate said periphery thereof so that said right section handles are integrally formed into said seat and are approximately coplanar with said seating plane.

2. A toilet seat as claimed in claim 1 wherein one of said left section handles and one of said right section handles are approximately aligned with the front-to-back center of gravity of a person seated on said toilet seat.

3. A toilet seat as claimed in claim 1 additionally comprising a front section in which is formed a handle by an opening extending through said seat proximate said periphery thereof so that said front section handle is integrally formed into said seat.

4. A toilet seat as claimed in claim 3 wherein said front section handle is approximately coplanar with said seating plane.

5. A toilet seat as claimed in claim 3 wherein said front section handle opening is larger than said left and right side handle openings.

6. A toilet seat as claimed in claim 1, additionally comprising:

a rear section;

a front section narrower than said rear section; and left and right transition sections extending from said left and right sections, respectively, to said front section; wherein said transition sections are shaped to accommodate the legs of a person seated on said toilet seat.

7. A toilet seat for use by persons in need of stabilization assistance, said toilet seat being used in cooperation with a toilet bowl having an upper rim, said toilet seat comprising:

an outer periphery that extends beyond said upper rim of said toilet bowl;

an upper surface that substantially defines a seating plane;

a left section in which are formed at least two handles by openings extending through said seat proximate said periphery thereof so that said left section handles are integrally formed into said seat and are approximately coplanar with said seating plane;

a right section in which are formed at least two handles by openings extending through said seat proximate said periphery thereof so that said right section handles are integrally formed into said seat and are approximately coplanar with said seating plane;

a front section in which is formed a handle by an opening extending through said seat proximate said periphery thereof so that said front section handle is integrally formed into said seat and is approximately coplanar with said seating plane; and left and right transition sections extending from said left and right sections, respectively, to said front section, wherein said transition sections are shaped to accommodate the legs of a person seated on said toilet seat.

* * * * *